US011795861B2

(12) United States Patent
Suda

(10) Patent No.: US 11,795,861 B2
(45) Date of Patent: Oct. 24, 2023

(54) COOLING SYSTEM

(71) Applicant: NIPPON THERMOSTAT CO., LTD., Kiyose (JP)

(72) Inventor: Hiroshi Suda, Kiyose (JP)

(73) Assignee: NIPPON THERMOSTAT CO., LTD., Tokyo (JP)

( * ) Notice: Subject to any disclaimer, the term of this patent is extended or adjusted under 35 U.S.C. 154(b) by 0 days.

(21) Appl. No.: 18/011,392

(22) PCT Filed: Apr. 28, 2021

(86) PCT No.: PCT/JP2021/016994
§ 371 (c)(1),
(2) Date: Dec. 19, 2022

(87) PCT Pub. No.: WO2022/004115
PCT Pub. Date: Jan. 6, 2022

(65) Prior Publication Data

US 2023/0265778 A1 Aug. 24, 2023

(30) Foreign Application Priority Data

Jul. 1, 2020 (JP) ..... 2020-114351

(51) Int. Cl.
*F01P 3/20* (2006.01)
*F01P 7/16* (2006.01)

(52) U.S. Cl.
CPC ..... *F01P 3/20* (2013.01); *F01P 7/161* (2013.01)

(58) Field of Classification Search
CPC .... F01P 3/20; F01P 7/161; F01P 7/165; F01P 2060/16
See application file for complete search history.

(56) References Cited

U.S. PATENT DOCUMENTS

2005/0139176 A1* 6/2005 Bergstrom ..... F01P 7/165 123/41.31
2006/0096553 A1* 5/2006 Takahashi ..... F01P 7/165 123/41.1

(Continued)

FOREIGN PATENT DOCUMENTS

JP 53-146827 U 11/1978
JP 61-47425 U 3/1986

(Continued)

OTHER PUBLICATIONS

International Search Report dated Jul. 6, 2021, issued in counterpart International Application No. PCT/ JP2021/016994. (3 pages).

*Primary Examiner* — Sizo B Vilakazi
(74) *Attorney, Agent, or Firm* — WHDA, LLP

(57) ABSTRACT

Provided are a cooling system and a method for controlling the same, with which it is possible to bleed air in a coolant flow path, quickly raise a coolant temperature to quickly heat air during air-heating, and quickly lower the coolant temperature to minimize knocking early when knocking occurs. A cooling system 1 comprises a main passage L1 through which a coolant is circulated between an internal combustion engine 2 and a radiator 3, an auxiliary passage 12 through which the coolant is circulated between the internal combustion engine and heat exchangers 4, 5, 6, a thermostat 7 that opens and closes the main passage L1 in response to the coolant temperature, a thermostat bypass path L3 that bypasses the thermostat 7 to allow communication between the internal combustion engine and the radiator, and a motor-operated valve 8 that opens and closes the auxiliary passage and the thermostat bypass path.

4 Claims, 4 Drawing Sheets

(56) References Cited

U.S. PATENT DOCUMENTS

| | | | | |
|---|---|---|---|---|
| 2006/0162676 | A1* | 7/2006 | Pegg | F01P 7/167 123/41.1 |
| 2006/0185362 | A1* | 8/2006 | Rogg | F02B 29/0412 60/599 |
| 2013/0255604 | A1* | 10/2013 | Rollinger | F01P 7/165 123/41.15 |
| 2016/0003127 | A1* | 1/2016 | Sakagawa | F01P 3/12 123/41.1 |
| 2016/0089970 | A1* | 3/2016 | Jackson | B60K 11/02 180/2.2 |
| 2018/0347448 | A1* | 12/2018 | Morota | F16K 11/0856 |

FOREIGN PATENT DOCUMENTS

| | | | |
|---|---|---|---|
| JP | 61-132431 | U | 8/1986 |
| JP | 6-1727 | U | 1/1994 |
| JP | 6-272557 | A | 9/1994 |
| JP | 2006-200406 | A | 8/2006 |
| JP | 2016-3578 | A | 1/2016 |
| JP | 2017-133622 | A | 8/2017 |

* cited by examiner

COOLING SYSTEM

TECHNICAL FIELD

This invention relates to a cooling system for an internal combustion engine.

BACKGROUND ART

The conventional cooling system for internal combustion engines is equipped with motor-operated valves to distribute the coolant cooling the internal combustion engines to various devices such as the radiator, air-heating heat exchanger, automatic transmission AT/continuously variable transmission CVT, and exhaust gas recirculation EGR.

A motor-operated valve with a thermo valve (thermostat valve) equipped with a safety function is used to prevent the internal combustion engine from overheating due to failing circulation of coolant to the radiator in the event of a failure (when a failure occurs).

A patent literature PTL 1 discloses a cooling system equipped with a motor-operated valve having a thermo valve. The cooling system equipped with a motor-operated valve having a thermo valve recited in PTL 1 will be described based on FIGS. 4 and 5.

As shown in FIG. 4, in a circulation system (cooling system) 50 of coolant for automobiles, a motor-operated valve 51 having a thermo valve is disposed on the side of the cylinder head CH of the internal combustion engine ENG.

The motor-operated valve 51 having a thermo valve distributes the coolant, which is pressurized by water pump WP and passes through the cylinder head CH, to an air-heating heat exchanger HT, oil cooler OC and radiator RAD via a first piping L1 through a third piping L3, respectively, and controls each flow rate thereof.

The motor-operated valve 51 having a thermo valve includes a reduction gear accommodated in a reduction gear housing 52, a valve body accommodated in a valve housing 53, and an electric motor accommodated in a motor housing 54, as shown in FIG. 5. The rotation of the motor is reduced by the reduction gear, and the valve body is configured to rotate by the rotation shaft connected to the reduction gear. The motor is controlled by an electric control unit (ECU) and controls the rotation of the valve body via the reduction gear in response to the state of the vehicle.

A first communicating port E1 of the motor-operated valve 51 having a thermo valve shown in FIG. 5 is connected to the piping L1 shown in FIG. 4 and communicates with the air-heating heat exchanger HT. A second communicating port E2 is connected to the second piping L2 and communicates with the oil cooler OC. A third communicating port E3 is connected to the third piping L3 and communicates with the radiator RAD.

Though not shown, a thermo valve as a failsafe mechanism is equipped at the third communicating port E3 and enables the valve housing 53 to communicate with the third communicating port E3 when the valve body cannot be driven due to failure or when the pressure or the temperature reaches the predetermined value.

The thermo valve as a failsafe mechanism, in the event of failure, opens when the coolant temperature rises to ensure the supply passage of the coolant to the radiator RAD and prevents the internal combustion engine ENG from overheating.

In the conventional cooling systems of the internal combustion engine, a thermostat may be used to open and close the passage of the coolant. A thermostat with a jiggle valve for air bleeding recited in patent literature PTL 2 is generally used.

The thermostat with a jiggle valve for air bleeding opens and closes the coolant passage in response to the coolant temperature. While the jiggle valve for air bleeding operates to let the air bleed from the coolant passage therethrough even when the thermostat is closed.

CITATION LIST

Patent Literature

PTL 1: JP-A-2017-133622
PTL 2: JP-UM-A-1978-146827

SUMMARY OF INVENTION

Technical Problem

In the case of a motor-operated valve with a thermo valve, the motor-operated valve has two main functions if roughly categorized: one is a cooling function to cool the internal combustion engine, and the other is a distributing function of the coolant to various devices such as the air-heating heat exchanger, automatic transmission AT/continuously variable transmission CVT, and exhaust gas recirculation EGR. In addition, the thermo valve as a fail-safe mechanism and the motor-operated valve are provided in an integrated unit, which makes it larger in size, poorly mountable in a vehicle, and expensive.

It can be proposed that as one of the solutions for the problems, the motor-operated valve with a thermo valve can be composed of three portions for each of the three functions. The functions of cooling the internal combustion engine and a fail-safe mechanism in the event of failure of the motor-operated valve are consolidated into a conventional thermostat using wax, and the function of the motor-operated valve is limited only to distributing the coolant to each of the devices. This makes it possible to reduce the size, improve the on-vehicle mountability, and reduce the cost.

In vehicles using a conventional motor-operated valve, since the warming-up time of the internal combustion engine is shortened for fuel consumption improvement, the flow rate of the coolant passing through the radiator is reduced, for a certain period of time immediately after the internal combustion engine is started. However, when a conventional thermostat is used, a thermostat (a thermo valve) with a jiggle valve for air bleeding is necessary to be used to bleed the air in the coolant passage.

The jiggle valve for air bleeding is configured to be closed by the pressure of the coolant. Since the coolant leaks through the jiggle valve for air bleeding even with the thermostat closed when a thermostat with a jiggle valve for air bleeding is used, it is difficult to warm up the engine promptly by raising the coolant temperature rapidly during air-heating. Further, though the conventional motor-operated valve can vary the coolant temperature to the desired temperature immediately, a new problem arises that because response delay occurs compared to the motor-operated valves when a conventional thermostat is used by separating the function thereof, suppression of knocking at an early stage by lowering the coolant temperature rapidly when knocking occurs is difficult.

The present invention is made to solve the above problem, and the object of the invention is to provide a cooling system capable of having an excellent on-vehicle mountability, bleeding the air in the coolant passage, air heating promptly by raising the coolant temperature rapidly during air-heating, and suppressing knocking at an early stage by lowering the coolant temperature rapidly when knocking occurs.

Solution to Problems

A cooling system according to the present invention includes

- an internal combustion engine,
- a radiator releasing heat from the coolant that cools the internal combustion engine,
- one or more heat exchangers other than the radiator,
- a main passage circulating the coolant between the internal combustion engine and the radiator,
- a thermostat that includes a temperature sensing unit for sensing the coolant temperature opening and closing the main passage depending on the coolant temperature,
- an auxiliary passage circulating the coolant between the internal combustion engine and the heat exchanger via a chamber in which the temperature sensing unit is disposed,
- a thermostat-bypass passage allowing the internal combustion engine to communicate with the radiator while bypassing the thermostat, and
- a motor-operated valve opening and closing the auxiliary passage and the thermostat-bypass passage.

The cooling system of the present invention allows the thermostat to open and close the main passages to circulate coolant passing through the radiator to the internal combustion engine and to stop the circulation of coolant passing through the radiator to the internal combustion engine. Further, the motor-operated valve opens and closes the auxiliary passage that circulates the coolant between the internal combustion engine and the heat exchanger and the thermostat-bypass passage (thermostat-bypass passage), whereby the coolant via the radiator bypasses the thermostat or the distribution of the coolant to the heat exchanger changes.

Here the heat exchanger denotes devices to which the coolant is supplied, such as an air-heating heat exchanger, ATF (automatic transmission fluid) warmer (CVT (continuously variable transmission) oil warmer), EGR (exhaust gas recirculation), and a throttle body. To bypass the thermostat means to bypass a portion that is opened or closed by the valve body of the thermostat.

According to the configuration above, depending on the coolant temperature, the thermostat opens and closes the main passage to circulate and stop circulating the coolant passing through the radiator to the internal combustion engine. Therefore, there is no need to provide a thermo valve as a fail-safe mechanism on the motor-operated valve. Namely, even when the motor-operated valve fails, overheating of the internal combustion engine ENG can be prevented because the thermostat opens and closes the main passage.

Accordingly, a thermo valve can be eliminated from the motor-operated valve. Further, the motor-operated valve can be downsized because it only needs to be able to open and close only the auxiliary passage and the bypassing passage of the thermostat. The downsizing of the motor-operated valve can improve the on-vehicle mountability and reduce cost.

More elaborately, since there is no need to dispose the downsized motor-operated valve in the vicinity of the water pump of the engine, it may be disposed anywhere in the middle of the thermostat-bypass passage and the auxiliary passage.

Moreover, the motor-operated valve opens and closes the thermostat-bypass passage that bypasses the thermostat. Thus, even if the jiggle pin is eliminated, opening the thermostat-bypass passage by the motor-operated valve allows the air in the coolant passage to bleed out via the thermostat-bypass passage.

In other words, the above configuration can eliminate the jiggle pin from the thermostat, thus preventing coolant leakage from the jiggle pin. This achieves air heating promptly by raising the coolant temperature rapidly when air heating and achieves suppressing knocking at an early stage when knocking occurs by lowering the coolant temperature rapidly.

Further, the thermostat of the cooling system according to the present invention may include a heater that heats the temperature sensing unit.

With such a configuration, for example, during continuous high-load traveling such as hill climbing, the thermostat can be stably kept open by heating the temperature sensing part (temperature-sensitive part) with a heater, and thus, the temperature of the coolant can be maintained at a low temperature even during high-load traveling.

In the present cooling system, the motor-operated valve may open the thermostat-bypass passage when the ignition switch to start the internal combustion engine is OFF.

In this way, the air in the coolant flow passage can be bled out via the thermostat-bypass passage when the ignition switch is turned off and the internal combustion engine is stopped; therefore, even if the internal combustion engine stops before the coolant temperature reaches the valve-opening temperature of the thermostat, the bleeding of the air in the coolant flow passage can be achieved.

The cooling system according to the present invention is provided with a control device for controlling the opening and closing of the motor-operated valve and may be constructed such that the control device closes the auxiliary passage and the thermostat-bypass passage by the motor-operated valve when determining that the internal combustion engine is in a warming-up operation, the control device, by the motor-operated valve, closes the thermostat-bypass passage and opens the auxiliary passage when determining that the warming-up operation is finished, and the control device opens the thermostat-bypass passage with the motor-operated valve even if determining that the warming-up operation is finished when determining that knocking occurs.

With this configuration, the main passage is closed with the thermostat, and the auxiliary passage and thermostat-bypass passage are closed with the motor-operated valve when the warming-up operation of the internal combustion engine with low coolant temperature is conducted. Consequently, the flow of the coolant flow passage of the cooling system is stopped, and the temperature of the coolant rises rapidly to achieve air heating quickly. Further, when the warming-up operation is completed, the auxiliary passage opens, so that the thermostat can sense the temperature and open the valve. Further, when knocking occurs, the thermostat bypass passage opens, and accordingly, the temperature of the coolant is lowered rapidly and knocking is suppressed at an early stage.

Advantageous Effects of Invention

The present invention allows to obtain a cooling system and a control method thereof, in which excellent mountability is provided, the air in the coolant flow passage can be bled, the quick air-heating can be achieved by rapidly raising the coolant temperature during air-heating, and knocking can be suppressed at an early stage by lowering the coolant temperature rapidly when knocking occurs.

DESCRIPTION OF EMBODIMENTS

A cooling system and a control method thereof of a first embodiment according to the present invention will be described on the basis of FIG. 1 and FIG. 2.

Outline of the Cooling System

Figure 1:
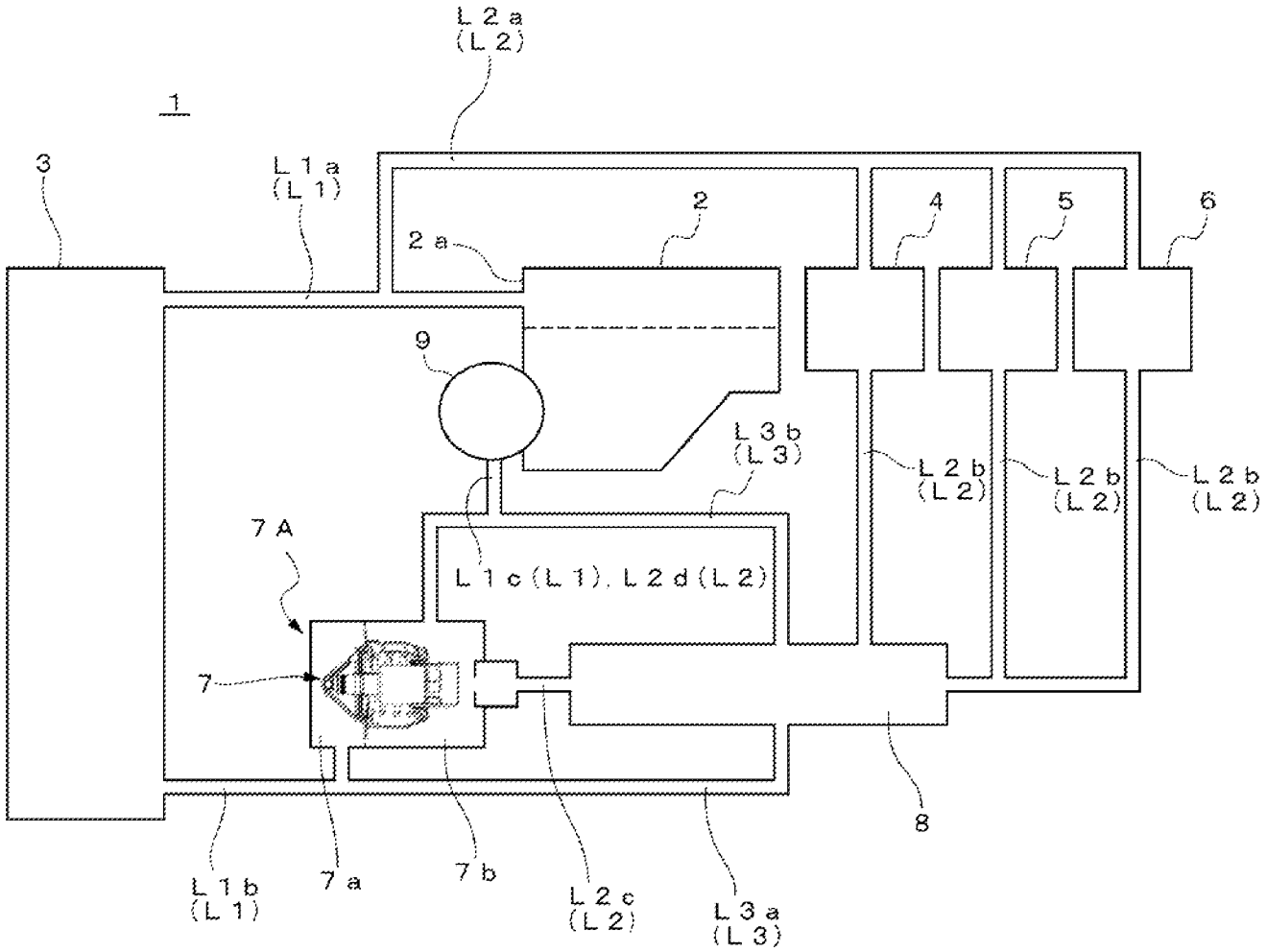
FIG. 1 is a schematic block diagram of a cooling system of a first embodiment according to the present invention.

In the cooling system 1 according to the present invention, as shown in FIG. 1, for example, the coolant cools an internal combustion engine 2, and the coolant that is circulated between a water jacket 2*a* of the internal combustion engine 2 and a radiator 3 is also circulated through heat exchangers, such as an air-heating heat exchanger 4, an automatic transmission fluid ATF warmer 5 (or a continuously variable transmission CVT oil warmer), and an exhaust gas recirculation EGR 6, and utilized individually at each device. The above-described heat exchangers are examples and the system is also usable in a throttle body.

The cooling system 1 is provided with a thermostat 7 that opens and closes a main passage L1 through which the coolant is circulated between a water jacket 2*a* of the internal combustion engine 2 and a radiator 3, an auxiliary passage L2 that communicates with a chamber (a second chamber 7*b*) where a temperature sensing unit 7B8 of the thermostat 7 is housed and through which the coolant circulates between the water jacket 2*a* and the heat exchangers of the air-heating heat exchanger 4, ATF warmer 5, CVT oil warmer, and the EGR 6 except for the radiator 3, and a motor-operated valve 8 for changing the distribution of the coolant provided to each heat exchanger by opening and closing the auxiliary passage L2.

The motor-operated valve 8 opens and closes a thermostat-bypass passage L3 bypassing the thermostat 7, while motor-operated valve 8 is opening the thermostat-bypass passage L3, the internal combustion engine 2 communicates with the radiator 3.

With this, the coolant cooling the internal combustion engine 2 can circulate between the internal combustion engine 2 and the radiator 3 without passing through the thermostat 7.

The cooling system 1 will be described below in detail.

Passage of the Cooling System

The cooling system 1 is provided with the main passage L1 through which the coolant circulates between the internal combustion engine 2 and the radiator 3, as shown in FIG. 1. In the present embodiment, the main passage includes a first main passage L1*a*, a second main passage Lib, and a third main passage L1*c*.

The first main passage L1*a* connects an outlet of the coolant of a water jacket 2*a* of the internal combustion engine 2 to a coolant inlet of the radiator 3, the second main passage Lib connects a coolant outlet of the radiator 3 to the thermostat 7, and the third main passage L1*c* connects the thermostat 7 to a suction port of a water pump 9.

The coolant sucked from the third main passage L1*c* and discharged from the water pump 9 is delivered to the water jacket 2*a*. Thus, the coolant flows via the internal combustion engine 2 and the radiator 3 through the main passage L1. The thermostat 7 opens and closes the connecting portion of the second auxiliary passage Lib to the third auxiliary passage L1*c* in the main passage L1 depending on the temperature of the coolant.

Further, the coolant system 1 is provided with an auxiliary passage L2 through which coolant circulates between the internal combustion engine 2 and the air-heating heat exchanger 4, the ATF warmer 5, or the CVT oil warmer, or the EGR 6. The auxiliary passage L2, in the present embodiment, is provided with a first auxiliary passage L2*a*, a second auxiliary passage L2*b*, a third auxiliary passage L2C, and a fourth auxiliary passage L2*d*.

The first auxiliary passage L2*a* connects a coolant outlet of the water jacket 2*a* respectively to the air-heating heat exchanger 4, the ATF warmer 5, or the CVT oil warmer, and the EGR 6.

The second auxiliary passage L2*b* connects each of the heat exchangers to the motor-operated valve 8, and the third auxiliary passage L2*c* connects the motor-operated valve 8 to the chamber (the second chamber 7*b* to be described later) in which the temperature sensing unit 7B8 of the thermostat 7 is provided.

The fourth auxiliary passage L2*d* connects the second chamber 7*b* to the suction port of the water pump 9.

The fourth auxiliary passage L2*d* and the third main passage L1*c* share a coolant pipeline. That is, the third main passage L1*c* is also connected to the second chamber 7*b* in which the temperature sensing unit 7B8 of the thermostat 7 is provided. The thermostat 7 allows or shuts the communication between the second main passage L1*b* and the third main passage L1*c* by sensing the surrounding temperature of the temperature sensing unit 7B8 in the second chamber 7*b*.

The motor-operated valve 8 opens and closes the second auxiliary passage L2*b* which leads to each of the heat exchangers such as the air-heating heat exchanger 4, the ATF warmer 5, or the CVT oil warmer, and the EGR 6, whereby the distribution of the coolant supplied to each heat exchanger is varied.

The cooling system 1 is provided with a thermostat-bypass passage L3 through which the coolant circulates between the internal combustion engine 2 and the radiator 3 with bypassing the thermostat 7.

The thermostat-bypass passage L3 is provided with an upper-stream side passage L3*a* connecting the midway of the second main passage L1*b* to the motor-operated valve 8 and a lower-stream side passage L3*b* connecting the motor-operated valve 8 to the midway of the third main passage L1*c*, in the present embodiment.

As described above, the second main passage Lib is connected to the radiator 3, and the third main passage L1*c* is connected to the water pump 9. Because of this configuration, even in a state where the thermostat 7 closes the main passage L1, when the motor-operated valve 8 opens the thermostat-bypass passage L3, the coolant flowing from the water jacket 2*a* goes toward the water pump 9 by passing through the first main passage L1*a*, radiator 3, the second main passage Lib, the thermostat-bypass passage L3, and the third main passage L1*c*.

Thermostat

The thermostat 7 is housed in a housing 7*a*, as shown in FIG. 1. The interior of the housing 7*a* is partitioned into two chambers 7*a* and 7*b* by a valve body 7B1 of the thermostat 7, which will be described later. If one of the two chambers is designated as a first chamber 7*a* and the other as a second chamber 7*b*, the second main passage Lib is connected to the first chamber 7*a*, and the third main passage L1*c* is connected to the second chamber 7*b*.

Figure 2:
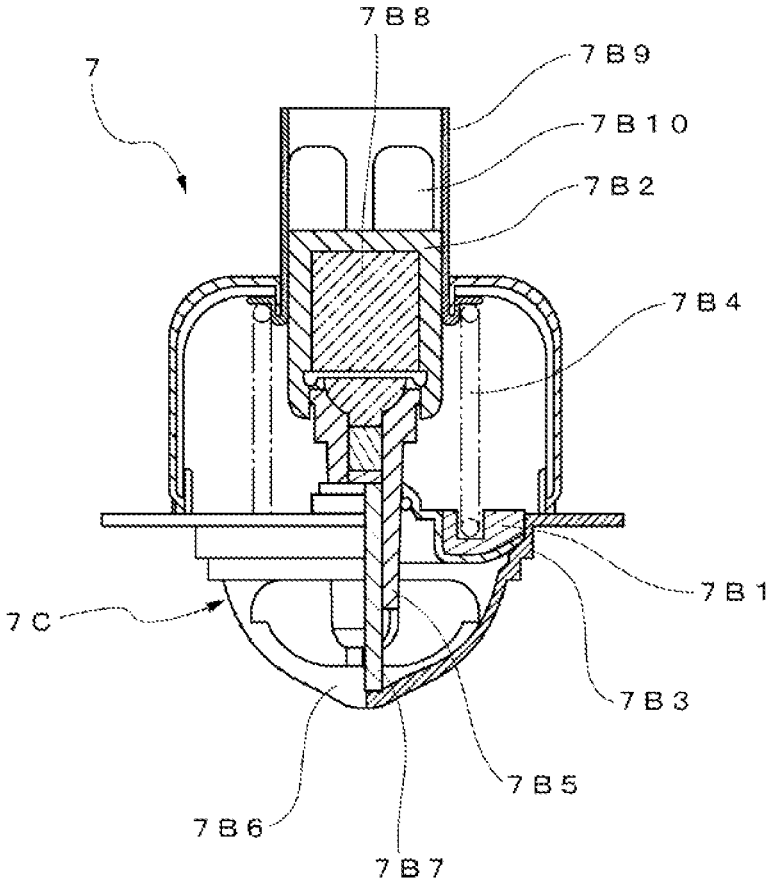
FIG. 2 is a cross-sectional view of a thermostat to be used in the cooling system of FIG. 1.

As shown in FIG. 2, the thermostat 7 is provided with a thermo-element 7B2 as a temperature-sensitive actuator, a valve body 7B1 driven by the thermo-element 7B2 to unseat from or to seat on a valve seat 7B3 to open or close the main passage L1, a spring 7B4 as a biasing member to bias the valve body 7B1 in a direction to normally close (a direction to seat the valve body on the valve seat 7B3), and a cylindrical holder 7B9 to which the coolant from the third auxiliary passage L2*c* flows in.

The thermo-element 7B2 is provided with a piston guide 7B5, a piston 7B7 whose tip end is engaged with a piston receiver 7B6, advancing and retracting while guided by the piston guide 7B5, and a temperature sensing unit (temperature-sensitive unit) 7B8 which incorporates wax as a thermal expander that makes the piston 7B7 advance and retract by expanding and contracting depending on the temperature variation of the coolant.

The holder 7B9 is disposed on the outer circumference of the temperature sensing unit 7B8, and the coolant coming from the third auxiliary passage L2*c* toward the fourth auxiliary passage L2*d* passes through the inside of the holder 7B9 and an opening 7B10 of the holder 7B9.

When the temperature of the coolant around the temperature sensing unit 7B8 rises to exceed a predetermined temperature and the wax in the temperature sensing unit 7B8 expands, the piston 7B7 is caused to push out and the valve body 7B1 unseats from the valve seat 7B3 to open the main passage L1.

Namely, when the valve body 7B1 leaves from the valve seat 7B3, the chambers 7*a* and 7*b* are communicated through the gap formed therebetween, and the second main passage Lib and the third main passage L1*c* communicate with each other. With this communication, the coolant cooled by passing via the radiator 3 is supplied to the internal combustion engine 2 through the main passage L1.

When the temperature of the coolant around the temperature sensing unit 7B8 falls down below a predetermined temperature, the wax incorporated in the temperature sensing unit 7B8 contracts. The piston 7B7 is pushed back by the biasing force of the spring 7B4 via the valve body 7B1, and the valve body 7B1 seats on the valve seat 7B3 and closes the main passage L1.

Thus, when thermostat 7 closes, the communication between the two chambers 7*a* and 7*b* is shut off, thereby shutting off the communication between the second main passage Lib and the third main passage L1*c*.

Although an example of a thermostat is described here, the configuration of the thermostat can be appropriately changed.

For example, in case the holder 7B9 is provided at the outer circumference of the temperature sensing unit, as described above, the temperature sensitivity of the thermostat 7 can be improved if the thermostat 7 is provided on the coolant inlet side of the internal combustion engine 2, but the holder 7B9 may be omitted. The thermostat 7 may also be equipped with an auxiliary valve to open and close the auxiliary passage L2 in addition to the valve element 7B1.

The valve seat 7B3 is formed on the frame 7C including the piston receiver 7B6 of the thermostat 7 in the present embodiment. The housing 7A, however, functions as a frame 7C and the valve seat 7B3 may be formed on the housing 7A. Further, the holder 7B9 may integrally be formed with the housing 7A.

Motor-operated valve 8

As the motor-operated valve 8, a typically-used one can be adopted. For example, the motor-operated valve recited in PTL 1 from which the thermo valve as a fail-safe mechanism is removed may be used. An example of the motor-operated valve 8 will be described below.

The motor-operated valve 8 is provided with a reduction gear housed in a reduction gear housing, a valve body housed in a valve body housing, and an electric motor housed in a motor housing. The motor-operated valve 8 is configured such that the valve body thereof is rotated (operated) by a rotation shaft connected to a reduction gear that reduces the rotation of the electric motor. A controller (ECU) mounted on a vehicle controls the electric motor and controls the rotation of the valve body (a rotary type valve body) through the reduction gear, according to the vehicle state.

The second auxiliary passage L2*b* connected to each of the heat exchangers such as the heat exchanger 4 for heating, the automatic transmission fluid ATF warmer 5 (or continuously variable transmission CVT oil warmer), and the exhaust gas recirculation EGR 5 is opened and closed by driving the rotation of the valve body, so that the distribution of the coolant to the heat exchangers is changed.

The valve body of the motor-operated valve 8 is not limited to a rotary type and may be a spool type valve body linearly movable. Further, direct opening and closing of a valve using a solenoid may be possible.

Operation and Action of the Cooling System

The second auxiliary passage L2*b* is opened or closed by the motor-operated valve 8 through electronic control based on information from various sensors provided in the vehicle, or by the driver's selection. This allows the air-heating heat exchanger 4, ATF 5, or CVT oil warmer, and the EGR 6 to be supplied or not supplied with the coolant.

The thermostat-bypass passage L3 is opened or closed by the motor-operated valve 8, by electronic control based on information from various sensors provided in the vehicle, depending on the status of the internal combustion engine and the temperature of the coolant. When the ignition to start the internal combustion engine 2 is turned off and the internal combustion engine is stopped, the motor-operated valve 8 is in a de-energized state. In such a de-energized state, the motor-operated valve 8 is set to open the thermostat-bypass passage L3. With this setting, the air in the coolant passage can be bled through the thermostat-bypass passage L3, even when the temperature of the coolant is low and the thermostat 7 is closed.

For this reason, it is needless to provide a jiggle pin for air bleeding in thermostat 7, and then the jiggle pin is omitted in thermostat 7. Namely, the air in the coolant passage can be bled even when a thermostat 7 without a jiggle valve for air bleeding is used.

Successively, an example of an electric control will be described. When the ignition is turned on, the control unit, after determining that the various electrical devices such as the electric valve 8 are operating normally, starts the internal combustion engine 2, and then starts warm-up operation. Further, when the control unit determines the warming-up operation is in process, the control unit outputs a command that the motor-operated valve 8 close the auxiliary passage L2 and close the thermostat-bypass passage L3. The determination of whether the warm-up operation is in the process may be performed using the temperature of the coolant detected by the temperature sensor or using the time elapsed from the start of the internal combustion engine 2.

Accordingly, during the warming-up operation, the communication of the auxiliary passage L2 and of the thermostat-bypass passage L3 is cut off by the motor-operated valve 8.

During the warming-up operation, the temperature of the coolant is low, and the thermostat 7 is closed to cut off the communication of the main passage L1. In this case, because no jiggle pin is provided in the thermostat 7 and the cold coolant passing through the radiator 3 does not leak from the place where a jiggle pin might have conventionally been provided, the temperature of the coolant rises rapidly, and the warming-up operation is quickly achieved.

Next, when the control unit determines that the warming-up operation of the internal combustion engine is completed, the control unit sends a command to the motor-operated valve 8 to close the thermostat-bypass passage L3 and to selectively open the second auxiliary passage L2*b* which is connected to each of the heat exchangers of the air-heating heat exchanger 4, the automatic transmission fluid ATF 5 (or continuously variable transmission CVT) oil warmer, and the exhaust gas recirculation EGR 6, depending on the temperature of the coolant.

This enables the coolant that is warmed by the internal combustion engine 2 to reach the temperature sensing unit 7B8 of the thermostat 7 through the auxiliary passage L2 and enables the thermostat 7 to sense the temperature of the warmed coolant.

In this case, if the temperature of the coolant reaches the valve-opening temperature of the thermostat 7, the thermostat 7 opens the main passage L1, and the coolant cooled by passing through the radiator 3 is supplied to the internal combustion engine 2 through the main passage L1.

Though in a warming-up operation, when the control unit determines that heating is necessary, for example, the control unit may send a command to the motor-operated valve 8 to open the second auxiliary passage L2*b* that leads to the air-heating heat exchanger 4.

When the control unit determines that knocking occurs, even with the determination that the warming-up operation has been completed, the control unit sends a command that the motor-operated valve 8 should open the thermostat-bypass passage L3. The determination as to whether knocking is occurring may be made based on information from the knocking sensor or may be based on information detected by other sensors.

Knocking occurs when the coolant temperature becomes high. This temperature rise of the coolant causes thermostat 7 to open the main passage L1, and further, by opening the thermostat-bypass passage L3 with the motor-operated valve 8, knocking can be suppressed at an early stage by lowering the coolant temperature quickly.

When the control unit determines that knocking is occurring, the control unit may send a command to the motor-operated valve 8 to open the thermostat-bypass passage L3 and to close the auxiliary passage L2. Since this increases the flow rate of coolant flowing to the radiator 3, knocking can be suppressed at an earlier stage.

Operation and Action of the Cooling System Using an Electronically-Controlled Thermo Valve An electronically-controlled thermostat incorporating a heater in the thermo-element 7B2 for heating the temperature sensing unit 7B8 may be used as a thermostat.

In a case where a non-electronically-controlled thermostat 7 without incorporating a heater is used, when cooled coolant flows into the second chamber 7*b* in which the temperature sensing unit 7B8 is disposed on opening of the thermostat 7, the valve body 7B1 of the thermostat 7 moves in the closing direction, then the flow rate of the coolant passing through the main passage L1 decreases.

In contrast, when an electronically-controlled thermostat is employed, the valve-opened state of the electronically-controlled thermostat can be maintained by heating the temperature sensing unit 7B8 with a heater.

With this, the temperature of the coolant can be maintained at a low temperature even in a traveling mode continuously highly loaded such as hill-climbing traveling.

Second Embodiment

Figure 3:
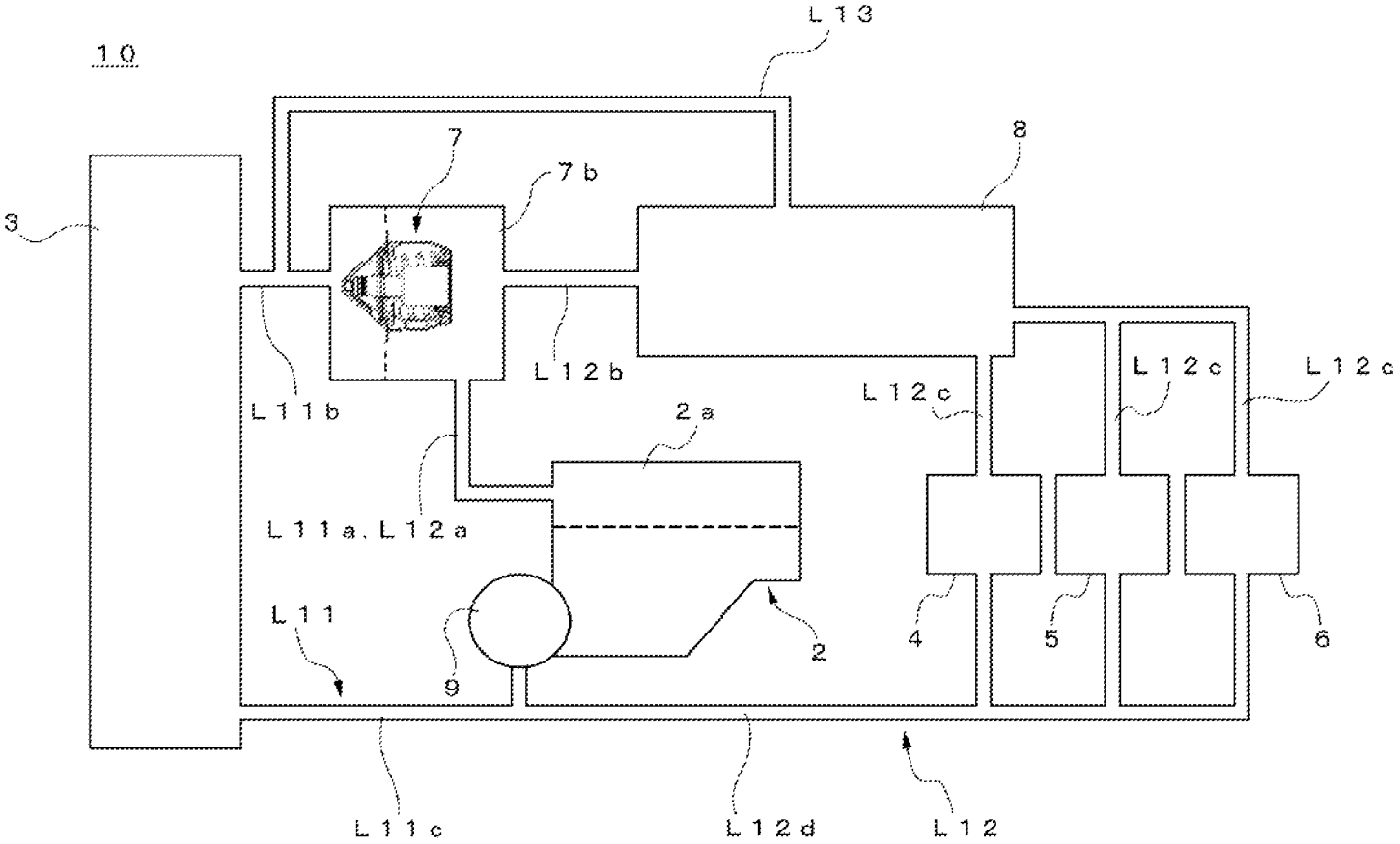
FIG. 3 is a schematic block diagram of a cooling system of a second embodiment according to the present invention.
Figure 4:
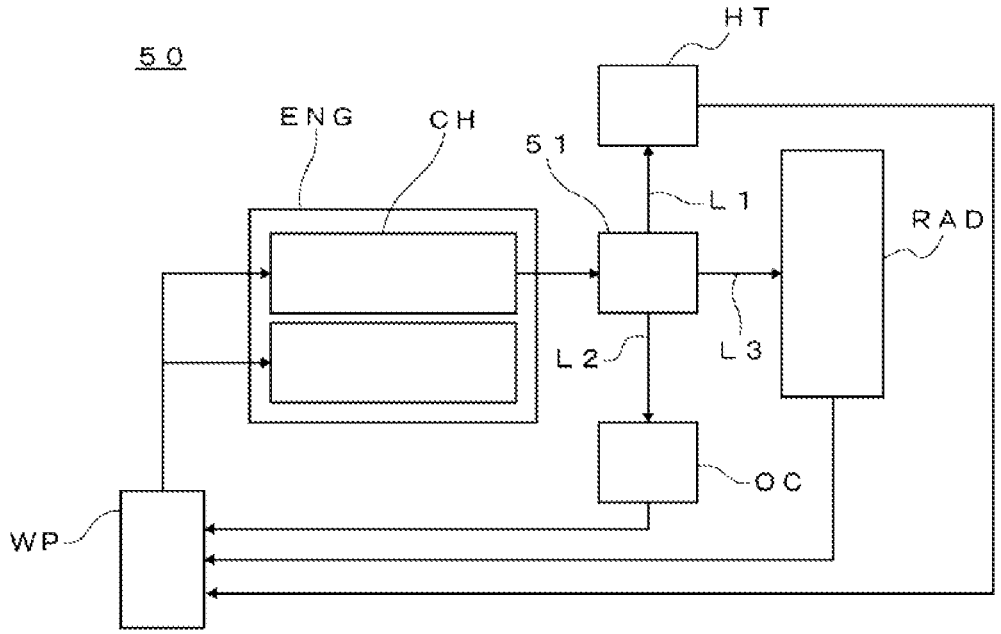
FIG. 4 is a schematic view of a conventional cooling system.
Figure 5:
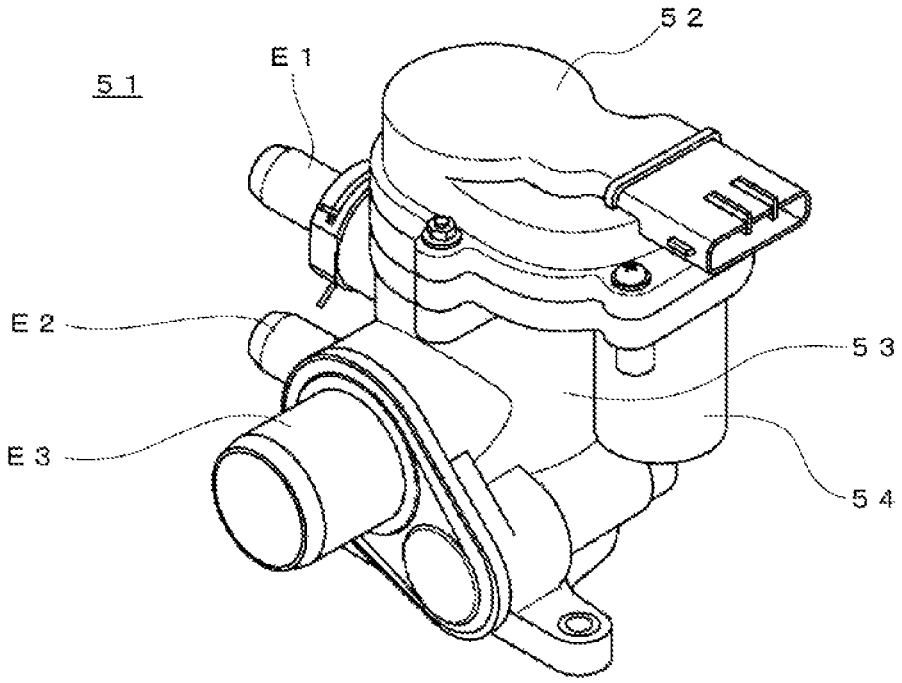
FIG. 5 is a perspective view of a motor-operated valve used in the cooling system of FIG. 4.

The thermostat 7, described in the first embodiment, is installed on the coolant inlet side of the internal combustion engine 2, but it may be installed on the coolant outlet side of the internal combustion engine 2, as shown in FIG. 3. Members identical or equivalent to those in the first embodiment have the same reference numbers, and the detailed descriptions will be omitted.

In the cooling system 10 of the second embodiment, as shown in FIG. 3, the main passage L11, through which the coolant circulates between the internal combustion engine 2 and the radiator 3, is provided with a first main passage L11*a*, a second main passage L11*b*, and a third main passage L11*c*.

The first main passage L11*a* connects the coolant outlet of the water jacket 2*a* of the internal combustion engine 2 to the thermostat 7, the second main passage L11*b* connects the thermostat 7 to the coolant inlet of the radiator 3, and the third main passage L11*c* connects the coolant outlet of the radiator 3 to the suction inlet of the water pump 9.

The coolant sucked from the third main passage L11*c* and discharged from the water pump 9 is delivered to the water jacket 2*a*. As stated above, the coolant flows via the internal combustion engine 2 and the radiator 3 through the main passage L11. The thermostat 7 opens and closes the connecting portion of the first main passage L11*a* and the second main passage L11*b* in the main passage L11 depending on the temperature of the coolant.

The cooling system 10 is provided with an auxiliary passage L12 through which the coolant circulates between the internal combustion engine 2 and the air-heating heat exchanger 4, the automatic transmission fluid ATF 5 (or continuously variable transmission CVT) oil warmer, and the exhaust gas recirculation EGR 6. In the present embodiment, the auxiliary passage L12 is provided with a first auxiliary passage L12*a*, a second auxiliary passage L12*b*, a third auxiliary passage L12*c*, and a fourth auxiliary passage L12*d*.

The first auxiliary passage L12*a* connects the coolant outlet of the water jacket 2*a* to the second chamber 7*b* where the temperature sensing unit 7B8 of the thermostat 7 is disposed. The second auxiliary passage L12*b* connects the second chamber 7*b*, where the temperature sensing unit 7B8 of the thermostat 7 is disposed, to the motor-operated valve 8. The third auxiliary passage L12*c* connects the motor-operated valve 8 to each of the heat exchangers such as the air-heating heat exchanger 4, the automatic transmission fluid ATF 5 (or continuously variable transmission CVT) oil warmer, and the exhaust gas recirculation EGR 6.

The fourth auxiliary passage L12*d* connects each of the heat exchangers to the suction inlet of the water pump 9.

The first auxiliary passage L12*a* shares piping with the first main passage L11*a*. In other words, the first main passage L11*a* is also connected to the second chamber 7*b* where the temperature sensing unit 7B8 of the thermostat 7 is located. The thermostat 7 senses the temperature around the temperature sensing unit 7B8 in the second chamber 7*b* and allows or shuts the communication between the first main passage L11*a* and the second main passage L11*b*.

The motor-operated valve 8 opens and closes the third auxiliary passage L12*c* leading to each of the heat exchangers such as the air-heating heat exchanger 4, the ATF warmer 5, or CVT oil warmer, and the EGR 6, whereby the distribution of coolant being supplied to each of the heat exchangers changes.

Further, the cooling system 10 is provided with a thermostat-bypass passage L13 through which the coolant circulates between the internal combustion engine 2 and the radiator 3 with bypassing the thermostat 7.

In the present embodiment, the thermostat-bypass passage L13 connects the motor-operated valve 8 to a midway of the second main passage L11*b*.

Even in a state where the thermostat 7 closes the main passage L11, when the motor-operated valve 8 opens the thermostat-bypass passage L13, the coolant flowing from the water jacket 2*a* goes to the water pump 9, passing through the first main passage L11*a*, the second auxiliary passage L12*b*, the thermostat-bypass passage L13, the second main passage L11*b*, the radiator 3, and the third main passage L11*c*.

Since the second embodiment thus configured, similar to the first embodiment, is provided with the thermostat 7 and the motor-operated valve 8, the coolant cooling the internal combustion engine 2 is switched between cases of going through and bypassing the thermostat 7.

As a result, also in the second embodiment, similar to the first embodiment, the air in the coolant flow passage can be bled, the quick air-heating can be achieved by rapidly raising the coolant temperature during air-heating, and knocking can be suppressed at an early stage by lowering the coolant temperature rapidly when knocking occurs, whereby effects similar to those of the first embodiment are obtainable.

REFERENCE SIGN LIST

1, 10 Cooling system
2 Internal combustion engine
3 Radiator
4 Air-heating heat exchanger (heat exchanger)
5 Automatic transmission fluid ATF warmer or continuously variable transmission oil warmer (heat exchanger)
6 Exhaust gas recirculation EGR (heat exchanger)
7 Thermostat (thermovalve)
7A Housing
7*a* First chamber
7*b* Second chamber (room)
8 Motor-operated valve
9 Water pump
L1, L11 Main passage
L2, L12 Auxiliary passage
L3, L13 Thermostat-bypass passage

The invention claimed is:

1. A cooling system, comprising:
an internal combustion engine;
a radiator for radiating heat from coolant for cooling the internal combustion engine;
one or more heat exchangers other than the radiator;
a main passage through which coolant circulates between the internal combustion engine and the radiator;
a thermostat that includes a temperature sensing unit to sense the temperature of the coolant and opens and closes the main passage depending on the temperature of the coolant;
an auxiliary passage through which the coolant circulates between the internal combustion engine and the heat exchangers via a room in which the temperature sensing unit is disposed;
a thermostat-bypass passage that communicates the internal combustion engine and the radiator by bypassing the thermostat; and
a motor-operated valve that opens and closes the auxiliary passage and the thermostat-bypass passage.

2. The cooling system according to claim 1, wherein the thermostat includes a heater to heat the temperature sensing unit.

3. The cooling system according to claim 1, wherein the motor-operated valve opens the thermostat-bypass passage with an ignition switch for starting the internal combustion engine being in a turn-off state.

4. The cooling system according to claim 1, further comprising:
a control device for controlling the opening and closing of the motor-operated valve, wherein the control device closes the auxiliary passage and the thermostat-bypass passage with the motor-operated valve when determining that the internal combustion engine is in a warming-up operation;
the control device, with the motor-operated valve, closes the thermostat-bypass passage and opens the auxiliary passage when determining that the warming-up operation is completed; and
the control device opens the thermostat-bypass passage with the motor-operated valve even if determining that the warming-up operation is completed, when determining that knocking is occurring.

* * * * *